US010619585B2

(12) United States Patent
Kwon et al.

(10) Patent No.: US 10,619,585 B2
(45) Date of Patent: Apr. 14, 2020

(54) METHOD FOR CONTROLLING STARTING OF VEHICLE UPON FAILURE OF CAMSHAFT POSITION SENSOR

(71) Applicants: Hyundai Motor Company, Seoul (KR); Kia Motors Corporation, Seoul (KR)

(72) Inventors: Hyeok-Jun Kwon, Seoul (KR); Chang-Jin Oh, Gyeonggi-do (KR); Chang-Hyun Lim, Seoul (KR); Jung-Suk Han, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 124 days.

(21) Appl. No.: 15/855,274

(22) Filed: Dec. 27, 2017

(65) Prior Publication Data

US 2019/0078525 A1 Mar. 14, 2019

(30) Foreign Application Priority Data

Sep. 8, 2017 (KR) ..... 10-2017-0115093

(51) Int. Cl.
*F02D 41/06* (2006.01)
*F02N 11/08* (2006.01)
(Continued)

(52) U.S. Cl.
CPC ..... *F02D 41/062* (2013.01); *F02D 41/222* (2013.01); *F02N 11/0862* (2013.01); *F02N 11/101* (2013.01); *F02D 2041/0092* (2013.01); *F02D 2041/227* (2013.01); *F02D 2041/228* (2013.01); *F02D 2200/06* (2013.01); *F02N 11/0848* (2013.01); *F02N 2200/063* (2013.01); *G07C 5/085* (2013.01)

(58) Field of Classification Search
CPC .... F02D 41/009; F02D 41/062; F02D 41/222; F02D 2041/0092; F02D 2041/288; F02D 2041/227; F02N 11/101; F02N 11/0862; F02N 11/0848; F02N 2200/063; F02N 2200/06; G07C 5/085
See application file for complete search history.

(56) References Cited

U.S. PATENT DOCUMENTS 4,690,122 A * 9/1987 Sasakura ..... F02P 3/0456 123/406.65
4,928,653 A * 5/1990 Ohkubo ..... F02D 35/023 123/435
(Continued)

FOREIGN PATENT DOCUMENTS

KR 2003-0029367 A 4/2003

*Primary Examiner* — Phutthiwat Wongwian
*Assistant Examiner* — Sherman D Manley
(74) *Attorney, Agent, or Firm* — Mintz Levin Cohn Ferris Glovsky and Popeo, P.C.; Peter F. Corless

(57) ABSTRACT

A method for controlling starting of a vehicle upon a failure of a camshaft position sensor includes performing a fuel injection and ignition at a particular timing for starting an engine of the vehicle; measuring a battery voltage of the vehicle after the performing of the fuel injection and ignition for starting the engine; and when the battery voltage rises over a predetermined value, determining that the fuel injection and the ignition are performed at a normal timing.

14 Claims, 7 Drawing Sheets

(51) Int. Cl.

| | |
|---|---|
| ***F02N 11/10*** | (2006.01) |
| ***F02D 41/22*** | (2006.01) |
| *G07C 5/08* | (2006.01) |
| *F02D 41/00* | (2006.01) |

(56) References Cited

U.S. PATENT DOCUMENTS 5,047,943 A * 9/1991 Takahata ..... F02D 41/009 123/406.51
5,604,304 A * 2/1997 Kokubo ..... F02D 41/009 701/101
5,905,315 A * 5/1999 Lefebvre ..... F02N 11/0848 307/10.3
5,970,936 A * 10/1999 Cabrera ..... F02N 11/0848 123/179.3
5,983,850 A * 11/1999 Vilou ..... F02N 11/0848 123/179.3
5,992,365 A * 11/1999 Vilou ..... F02N 11/0848 123/179.3
6,170,462 B1 * 1/2001 Kondo ..... F02D 41/009 123/406.18
6,438,487 B1 * 8/2002 Mingo ..... F02N 11/0859 123/179.3
6,457,465 B2 * 10/2002 Lee ..... F02D 41/009 123/643
6,459,267 B1 * 10/2002 Nishimoto ..... F02D 41/009 324/378
6,879,905 B2 * 4/2005 Koseki ..... F02N 11/0848 123/179.18
7,061,130 B1 * 6/2006 Blackburn ..... F02N 11/04 180/65.22
7,913,548 B2 * 3/2011 Ono ..... F02D 41/0097 73/114.25
2002/0092499 A1 * 7/2002 Kargilis ..... F02D 35/027 123/406.58
2003/0154774 A1 * 8/2003 Baeuerle ..... F02D 41/009 73/114.62
2003/0163247 A1 * 8/2003 Kobayashi ..... F02D 41/009 701/114
2007/0246012 A1 * 10/2007 Ando ..... F02D 41/009 123/406.13
2012/0101708 A1 * 4/2012 Hirai ..... F02D 41/009 701/103
2013/0197786 A1 * 8/2013 Genko ..... F02D 41/00 701/108
2017/0175654 A1 * 6/2017 Eom ..... F02D 41/009
2018/0100461 A1 * 4/2018 Eom ..... F02D 41/062

* cited by examiner

METHOD FOR CONTROLLING STARTING OF VEHICLE UPON FAILURE OF CAMSHAFT POSITION SENSOR

CROSS-REFERENCE TO RELATED APPLICATIONS

This application claims the benefit of priority to Korean Patent Application No. 10-2017-0115093, filed on Sep. 8, 2017, which is hereby incorporated by reference in its entirety as if fully set forth herein.

BACKGROUND OF THE DISCLOSURE

Technical Field

Embodiments of the present disclosure relate to a method for controlling starting of a vehicle and, more particularly, to a method for controlling starting of a vehicle capable of solving a problem in that an engine cannot be started due to desynchronization of the engine when a camshaft position sensor fails.

Description of Related Art

In a vehicle equipped with an internal combustion engine, injection timing and ignition timing of fuel are controlled according to a driving condition of the vehicle. Specifically, in the case of a multi-cylinder engine, there is a need to accurately synchronize the injection timing and ignition timing of fuel for each cylinder in order to prevent generation of harmful gas resulting from output reduction or incomplete combustion.

In order to perform synchronization of the engine, there is a need to accurately detect a rotational position of a crankshaft for each cylinder. Conventionally a crankshaft position sensor and a camshaft position sensor are used to detect an accurate position of the crankshaft.

When engine control timing does not coincide with a target timing, starting of the engine fails. Accordingly, for stable starting of the engine, it is necessary to obtain an accurate engine control timing from the camshaft position sensor and the crankshaft position sensor.

FIG. 1 illustrates an example of an engine synchronization device. The engine synchronization device illustrated in FIG. 1 is configured with a camshaft position sensor 100, a crankshaft position sensor 200, and an electronic control unit (ECU) 300.

The camshaft position sensor 100 senses cam edges of an intake cam and an exhaust cam when a camshaft is rotated, and outputs the sensed cam edges to the ECU 300 as a cam signal in a form of a pulse having a voltage phase that is reversed between a high level H and a low level L. For example, when an output of the camshaft position sensor 100 is a high level H, a cam 110 is positioned over a line L1 that is represented by a dotted line, and, when the output of the camshaft position sensor 100 is a low level L, the cam 110 is positioned below the line L1. Here, the cam 110 is configured to open and close an intake valve and an exhaust valve which are provided in a combustion chamber, and the camshaft is rotated in synchronization with a crankshaft.

The crankshaft position sensor 200 is disposed near a sensor wheel 210 which is coaxially provided at the crankshaft. A plurality of teeth 220 are installed along an outer circumference of the sensor wheel 210. The crankshaft position sensor 200 senses a tooth in the form of a protruding groove to detect a rotational angle and the number of revolutions of the crankshaft. The crankshaft position sensor 200 outputs the detected result to the ECU 300 as a crank signal in a form of a pulse. Some teeth are not formed in a circumferential direction of the sensor wheel 210, thereby being missed from a portion of the sensor wheel 210, and thus the crankshaft position sensor 200 recognizes this portion as a missing tooth 230.

The ECU 300 receives the cam signal and the crank signal from the camshaft position sensor 100 and the crankshaft position sensor 200, respectively, and determines a crank position and a cam position using the received results. Then, the ECU 300 controls a fuel pump 400, an injector 500, and a spark plug 600 using the determined crank position and the determined cam position, thereby synchronizing the injection timing and ignition timing of fuel for each cylinder of the engine.

An actual crank angle sensed by the crankshaft position sensor 200 is between a range of 0° to 720°, not in a range of 0° to 360°. This is because the crankshaft is rotated twice during four strokes of the engine (i.e., an intake stroke, a compression stroke, an explosion stroke, and an exhaust stroke) (at this point, the camshaft is rotated once). That is, input signal patterns of the crankshaft position sensor 200 in two sections of 0° to 360° and 0° to 720° are the same as each other. Therefore, as shown in FIG. 2, since positions of cylinders 1 and 4 are recognized as the same position, and also positions of cylinders 2 and 3 are recognized as the same position when the determination is performed on the basis of the input signal of the crankshaft position sensor 200, the cylinders 1 and 4 performing different strokes are difficult to be distinguished from each other based only on the input signal of the crankshaft position sensor 200.

Consequently, in order to perform fuel injection and ignition at proper positions during the four strokes of the engine, a section determination should be performed for a crank angle in a range of 0° to 360° and in a range of 0° to 720°. For this purpose, a signal of the camshaft position sensor 100 is used. When an electrical or physical failure occurs at the camshaft position sensor 100, however, the section determination for the crank angles in the range of 0° to 360° and in the range of 0° to 720° is difficult, and thus an engine synchronization fails, making starting of the engine impossible.

In order to accurately determine the crank angle, a conventional method involves injecting and igniting fuel in an arbitrary cylinder in which a piston is positioned at a top dead-point using only the signal of the crankshaft position sensor 200, and then monitoring a variation in revolutions per minute (RPM) of the engine. When the cylinder in which ignition is performed is not in the compression stroke, even though the fuel injection and ignition are performed, as shown in FIG. 6, there is no variation in the RPM of the engine. In this case, when the crank angle is offset by 360°, and the fuel injection and ignition are performed again to restart the engine, the ignition is performed at a normal position in the compression stroke. Therefore, the RPM of the engine rises.

However, the variation in RPM of the engine is occasionally too small or irregular due to external environments, such as the temperature and atmospheric pressure of the air, and the voltage state of a vehicle battery, and the like. In this case, there is a possibility that determining a starting completion (i.e., a crank angle determination) on the basis of the RPM of the engine is either impossible or the result is ambiguous.

SUMMARY OF THE DISCLOSURE

Embodiments of the present disclosure are directed to a method for controlling starting of a vehicle, which is capable of starting an engine by detecting an accurate crank angle without being affected by external environments, even when a failure occurs at a camshaft position sensor.

In order to solve the above-described problems, when test injection and ignition are performed in an arbitrary cylinder in which a piston is positioned near a top dead-point using only a sensor signal of a crankshaft position sensor, the present disclosure refers to a battery voltage, not to revolutions per minute (RPM) of an engine.

According to embodiments of the present disclosure, a method for controlling starting of a vehicle upon a failure of a camshaft position sensor includes: performing a fuel injection and ignition at a particular timing for starting an engine of the vehicle; measuring a battery voltage of the vehicle after the performing of the fuel injection and ignition for starting the engine; and when the battery voltage rises over a predetermined value, determining that the fuel injection and the ignition are performed at a normal timing.

The method may further include, when the battery voltage of the vehicle does not rise over the predetermined value after the performing of fuel injection and ignition for starting the engine, determining that the fuel injection and the ignition are not performed at the normal timing; and when the fuel injection and the ignition are not performed at the normal timing, offsetting a crank angle, which is recognized through measurement, by 360° to restart the engine.

The method may further include driving a starter motor of the engine in response to an ignition key being turned on; performing a test fuel injection and ignition based on a predetermined crank angle; monitoring the battery voltage after the performing of the test injection and ignition; and when the battery voltage rises over the predetermined value after the performing of the test injection and ignition, determining that the test injection and ignition are performed at the normal timing to complete determination of the crank angle.

The method may further include, when the battery voltage does not rise over the predetermined value after the performing of the test injection and ignition, performing the fuel injection and ignition based on the crank angle offset by 360° to restart the engine.

The method may further include, after the starter motor is driven, determining whether the camshaft position sensor fails.

The method may further include, when a failure is determined to occur at the camshaft position sensor, executing a limp-home mode.

The method may further includes measuring the battery voltage before the starter motor is driven; and setting the measured battery voltage as the predetermined value.

The method may further include, when the battery voltage does not rise over the predetermined value after the restarting of the engine, re-offsetting the offset crank angle by 360° to restart the engine based on the re-offset crank angle.

The method may further include counting a number of times the offsetting of the crank angle and the re-offsetting of the crank angle are performed; and when the number of times is greater than or equal to a predetermined value, determining that the starting of the engine is disabled.

The method may further include, when the battery voltage does not rise over the predetermined value after the performing of the fuel injection and ignition for starting the engine, determining whether an abnormality occurs at a part of the vehicle related to combustion; and when the abnormality is determined to occur at the part of the vehicle related to combustion, determining that the starting of the engine is disabled.

The part of the vehicle related to combustion may be an injector, a spark plug, or a fuel pump.

The method may further include, when the battery voltage does not rise over the predetermined value after the restarting of the engine, determining whether an air-fuel ratio is within a normal range; and when the air-fuel ratio is outside of the normal range, determining that the starting of the engine is disabled.

The method may further include, when it is determined that the starting of the engine is disabled, stopping the driving of the starter motor of the engine; and notifying a driver of the vehicle of a failure.

The method may further include, when it is determined that the starting of the engine is disabled, storing a diagnostic trouble code (DTC) related to failure information of the camshaft position sensor in a storage device of the vehicle.

The test injection and the ignition may be performed for an arbitrary cylinder proximate to a top dead-point using the crankshaft position sensor.

BRIEF DESCRIPTION OF THE DRAWINGS

The embodiments herein may be better understood by referring to the following description in conjunction with the accompanying drawings, briefly described below, in which like reference numerals indicate identically or functionally similar elements.

Figure 1:
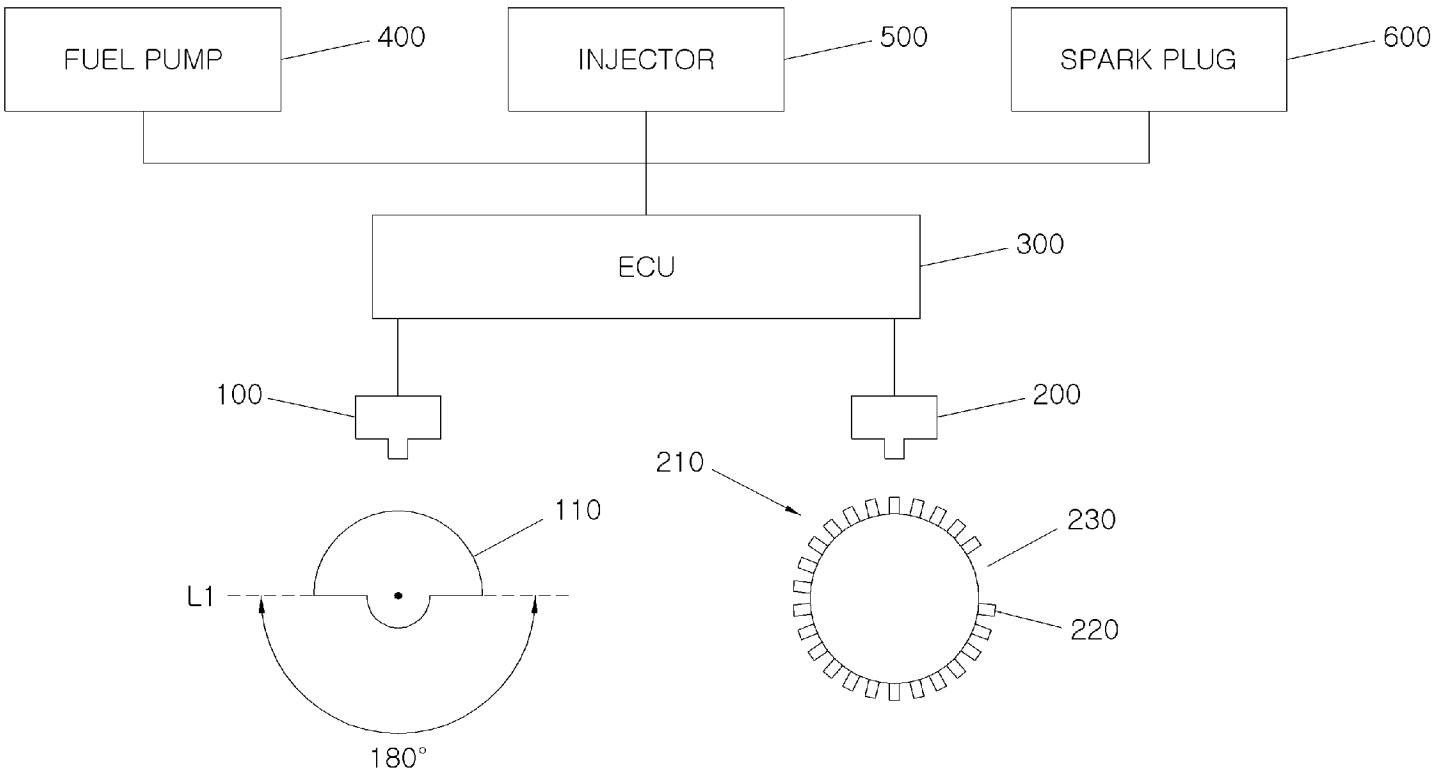
FIG. 1 is a block diagram illustrating a schematic configuration of an engine synchronization device.
Figure 2:
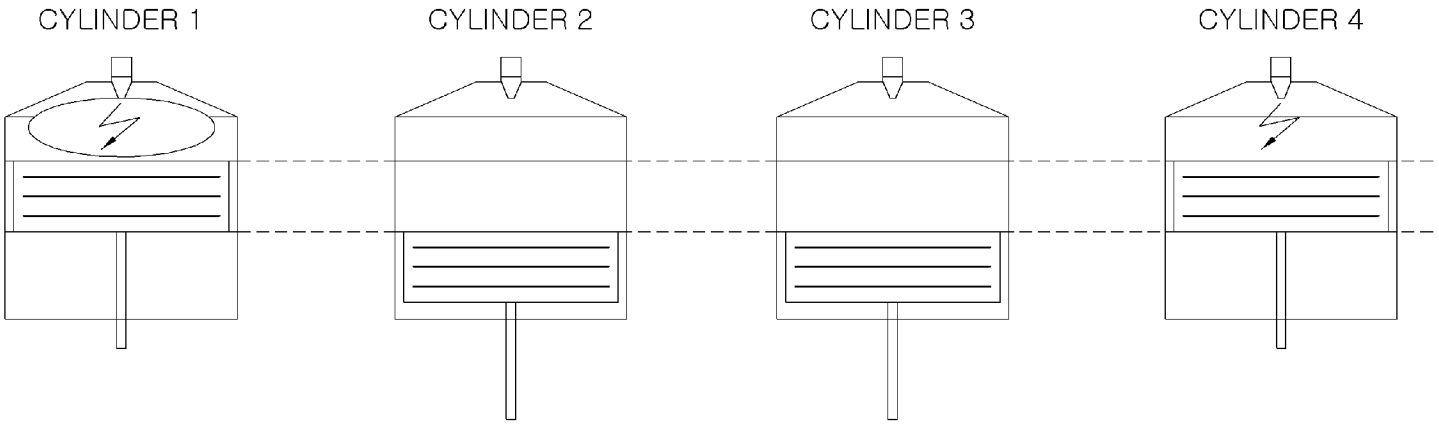
FIG. 2 is a reference view illustrating piston positions in a plurality of cylinders at the same timing in relation to a crank angle section.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF THE EMBODIMENTS

Hereinafter, embodiments according to the present disclosure will be described in detail with reference to the accompanying drawings. As those skilled in the art would realize, the described embodiments may be modified in various different ways, all without departing from the spirit or scope of the present disclosure. Further, throughout the specification, like reference numerals refer to like elements.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Additionally, it is understood that one or more of the below methods, or aspects thereof, may be executed by at least one controller/control unit. The term "controller" or "control unit" may refer to a hardware device that includes a memory and a processor. The memory is configured to store program instructions, and the processor is specifically programmed to execute the program instructions to perform one or more processes which are described further below. Moreover, it is understood that the below methods may be executed by an apparatus comprising the at least one controller/control unit in conjunction with one or more other components, as would be appreciated by a person of ordinary skill in the art.

Figure 3:
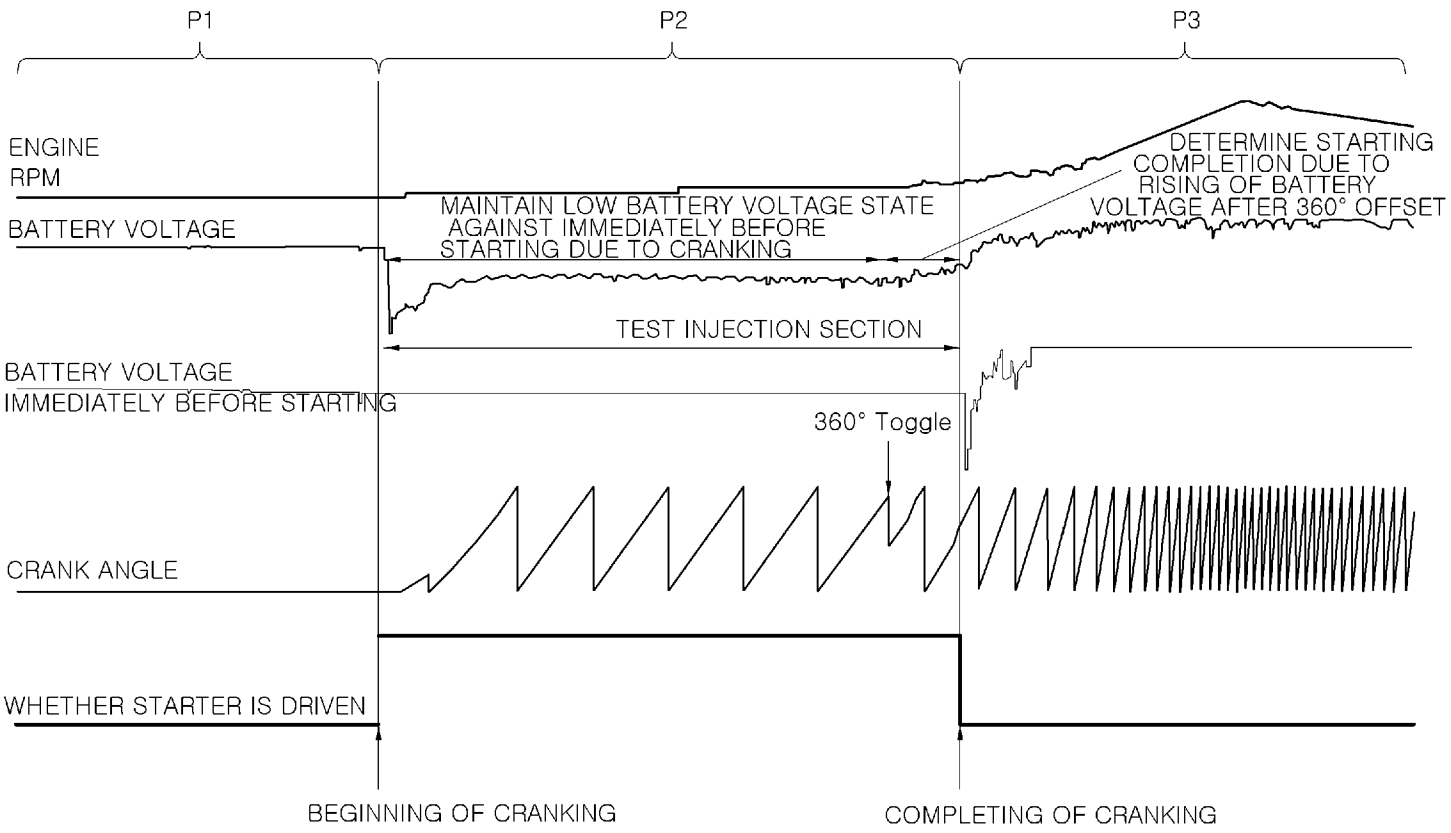
FIG. 3 is a reference diagram for describing the principle of solving the problems by the present disclosure.

Referring now to the presently disclosed embodiments, FIG. 3 is a reference diagram for describing the principle of solving the above-described problems by the present disclosure. In FIG. 3, P1 represents a state before starting (before a starter motor is driven). In the present disclosure, a controller measures and stores a battery voltage value which is used as a reference for a crank angle section determination in this state. P2 represents a state during starting (during the starter motor is driven). Here, since crank angle sections in a range of 0° to 360° and in a range of 360° to 720° are in an undetermined state, test injection is performed according to a currently recognized crank angle (i.e., fuel injection and ignition are performed).

At this point, the voltage is rapidly reduced due to the driving of the starter motor. When the fuel injection and the ignition are performed at an incorrect position, as shown in P2, the starting is not completed and the starter motor is continuously driven, so that the battery voltage does not rise again. Consequently, when the battery voltage does not rise again even though the test injection has been performed while the starter motor rotates the engine with a predetermined RPM and thus the crank angle is varied, this may be determined that the fuel injection and the ignition are performed at the incorrect position. That is, it may be determined that the crank angle sections in the range of 0° to 360° and in the range of 360° to 720° are incorrectly recognized.

Accordingly, in order to restart the engine in a correct section, an electronic control unit (ECU) according to the present disclosure offsets the crank angle by 360° to restart the engine. P3 represents a starting completion determination state when the engine is restarted. After the crank angle is offset by 360°, the fuel injection and the ignition are performed at an engine position corresponding to a current stroke of the four strokes so that an explosion occurs, and the driving of the starter motor is stopped such that the battery voltage rises. Consequently, when a current battery voltage rises over a predetermined ratio with respect to the battery voltage stored before the starting, it may be determined that the starting is completed.

Figure 4:
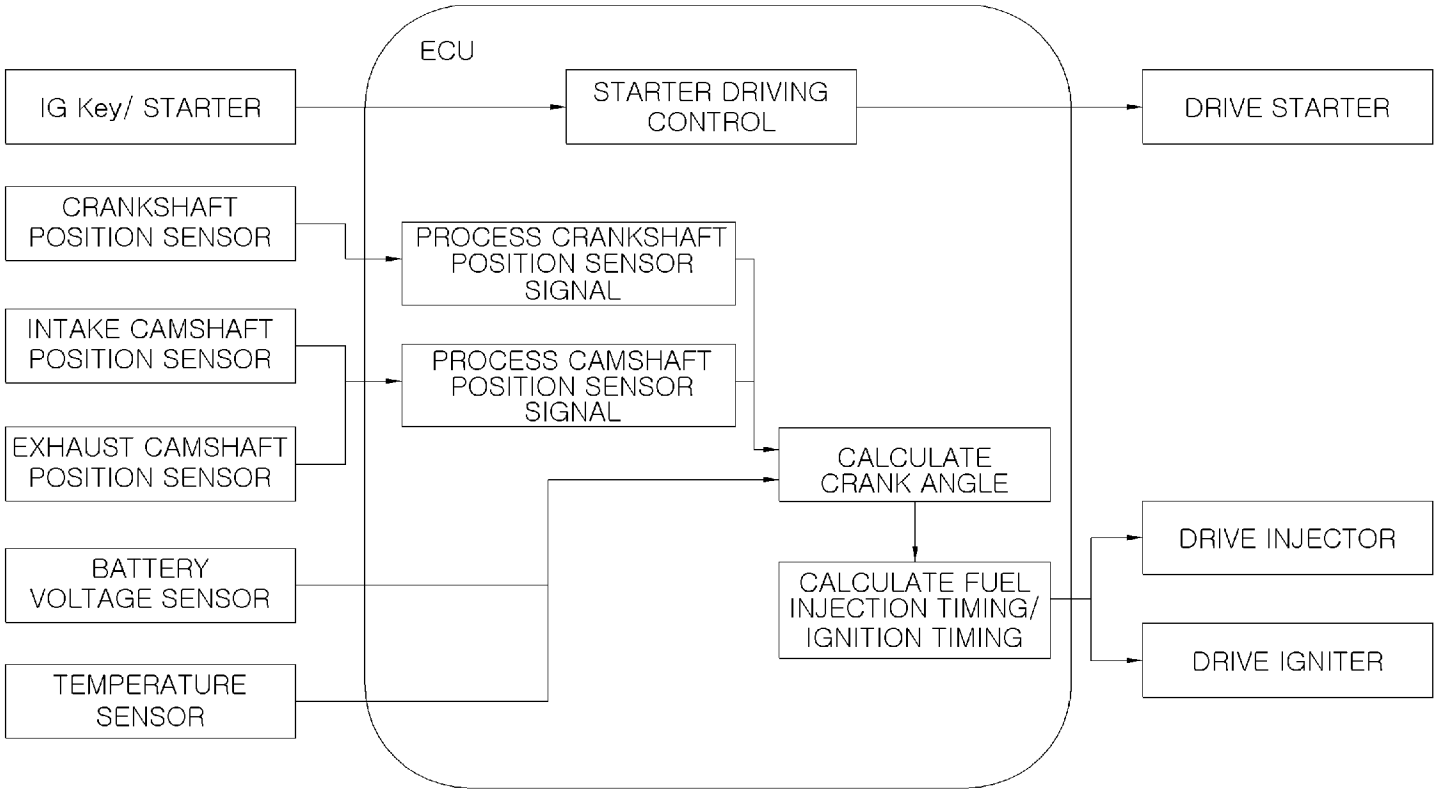
FIG. 4 is a block diagram illustrating a configuration of a starting control system to which embodiments of the present disclosure is applicable.

FIG. 4 is a block diagram illustrating a configuration of a starting control system to which embodiments of the present disclosure are applicable.

A method for controlling starting according to embodiments of the present disclosure is performed through an electronic control unit (ECU). The ECU serves to start an engine by accurately determining a crank angle in each of a plurality of cylinders to calculate a fuel injection timing and an ignition timing, and controlling an injector and an igniter to be driven at the fuel injection timing and the ignition timing, respectively.

More specifically, when an ignition (IG) key and a starter driving command are turned on by a driver, the ECU controls driving of the starter motor to forcibly rotate the engine. Also, in order to perform engine synchronization control, the ECU receives measured signals from a crankshaft position sensor and camshaft position sensors of an intake cam and an exhaust cam so as to accurately detect the crank angle. Subsequently, the ECU processes the received signals to calculate a current crank angle, and calculates an accurate fuel injection timing and an accurate ignition timing on the basis of the calculated crank angle. Thereafter, the ECU controls the injector and the igniter to perform fuel injection and ignition at the fuel injection timing and the ignition timing, respectively.

Meanwhile, the ECU according to the present disclosure receives a measured voltage signal of a battery from a battery voltage sensor, and uses the received voltage signal to determine the crank angle as it will be described below. Further, the ECU may also receive information on a temperature of the engine from a sensor device such as a cooling water temperature sensor, and use the received information to determine the crank angle.

Figure 5A:
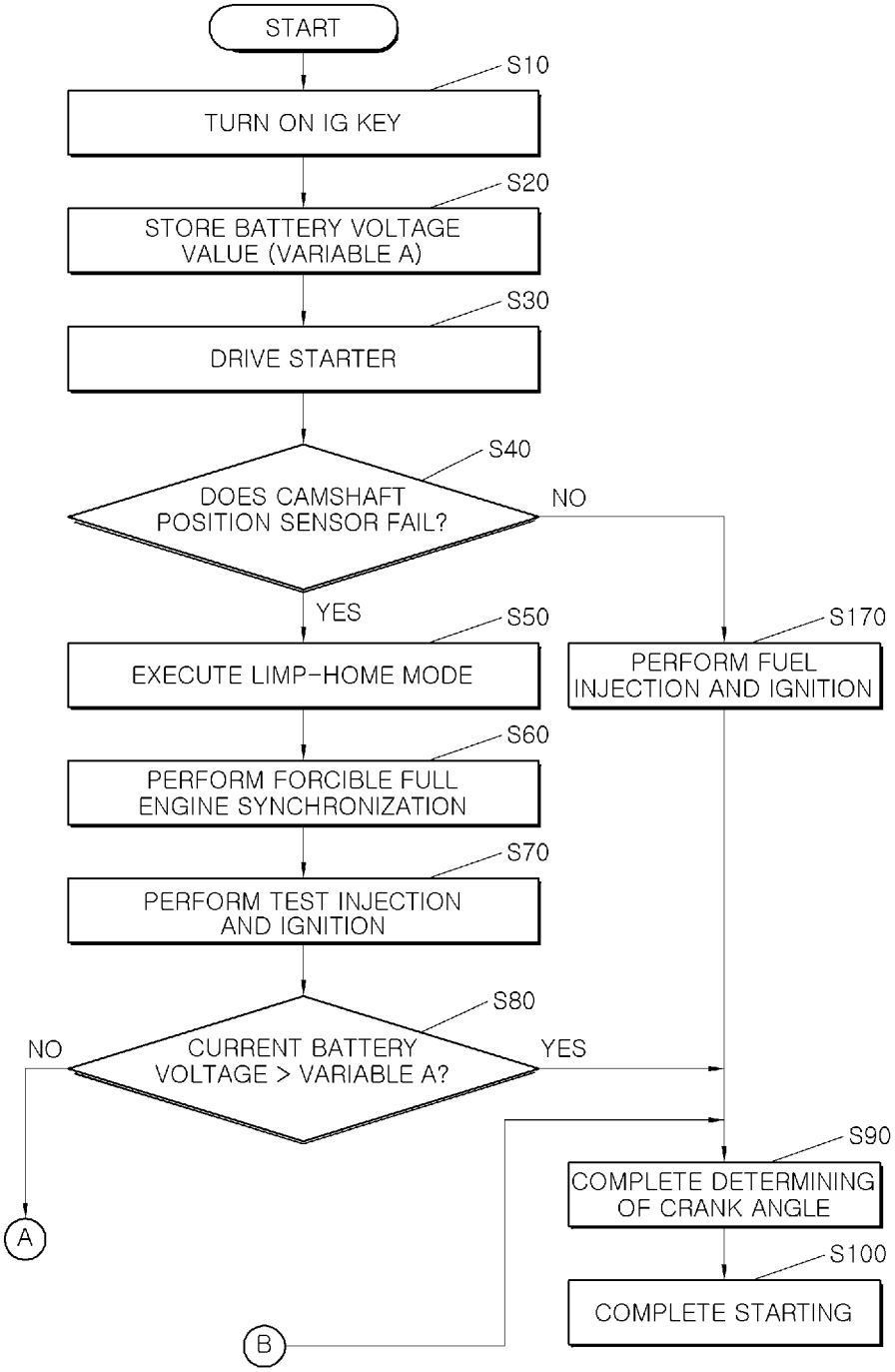
FIGS. 5A and 5B are flowcharts illustrating a method for controlling starting according to embodiments of the present disclosure.
Figure 5B:
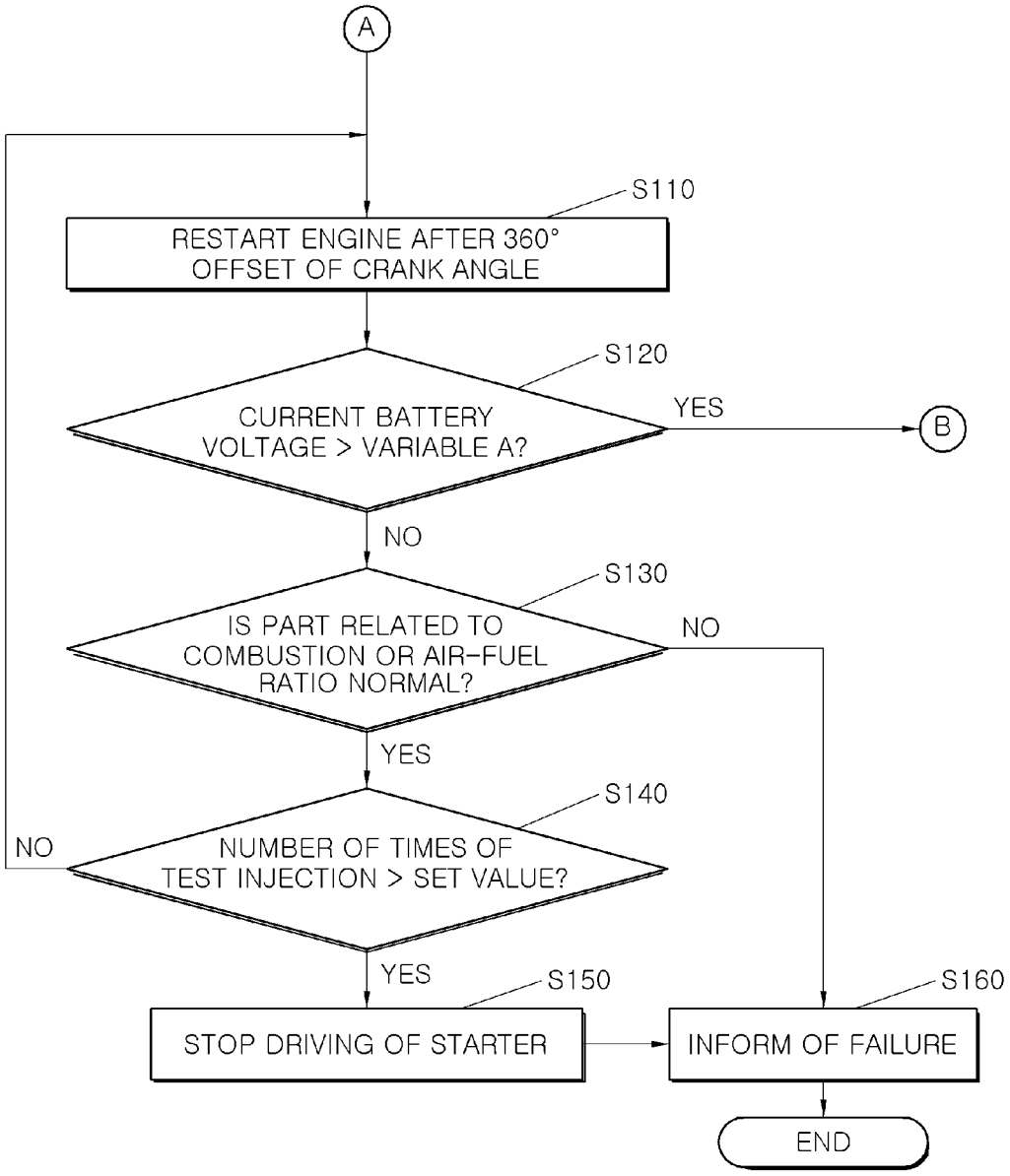
Figure 6:
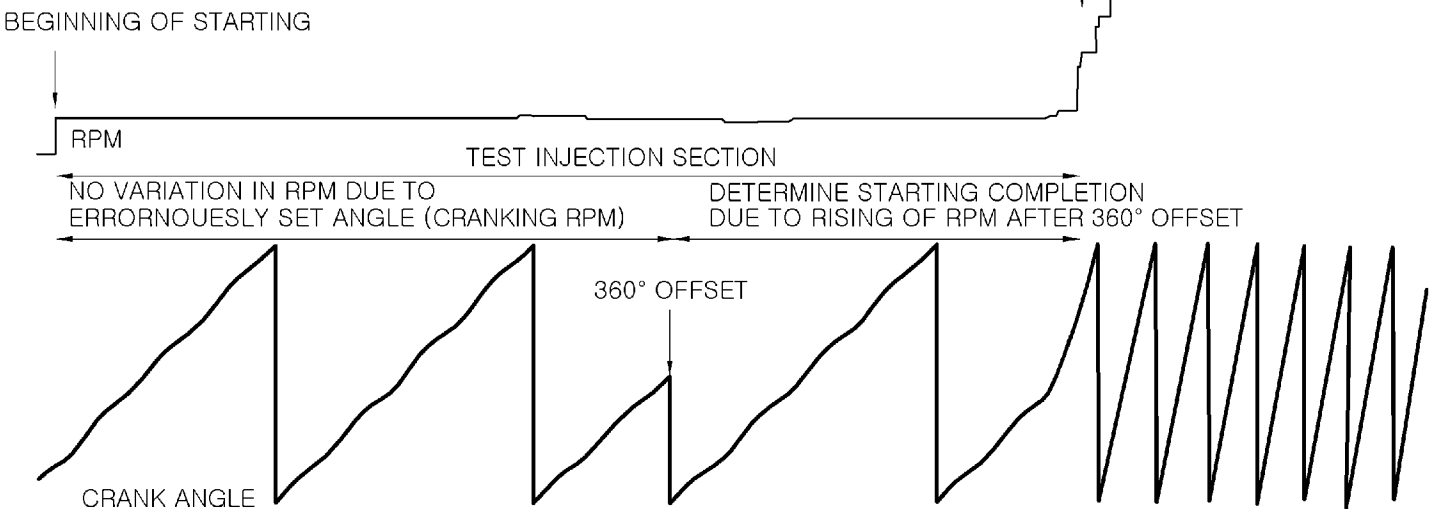
FIG. 6 is a signal diagram illustrating a variation in revolutions per minute (RPM) of an engine when test injection is performed in the engine.

FIGS. 5A and 5B are flowcharts illustrating a method for controlling starting according to embodiments of the present disclosure.

As shown in FIGS. 5A and 5B, when the engine is started, the IG key is first turned on according to a manipulation of a starting device by a driver (S10). Thus, the method for controlling starting according to the present disclosure begins.

Before the starter motor is driven immediately after the IG key is turned on, the ECU stores a battery voltage value A at a corresponding timing from the battery voltage sensor (S20). As described below, the battery voltage value A stored at the corresponding timing may be a reference value that is used for determining the crank angle. However, since the battery voltage value is continuously varied due to states of the vehicle and the battery or external environments such as a temperature of the outside air and the like, a battery voltage value serving as a reference for determining a crank angle section determination is newly stored whenever the starting is performed. Through such a process, determination for the crank angle and whether the starting is completed may be independently performed from a variation of the external environments.

The ECU stores the battery voltage value A, and then drives the starter motor. As shown in FIG. 3, when the starter motor is driven, the battery voltage is abruptly reduced due to a load applied to the starter motor.

Thereafter, the ECU determines whether the camshaft position sensors of the intake cam and the exhaust cam fail. For example, whether the camshaft position sensors fail may be determined through diagnostic information using an application specific integrated circuit (ASIC) provided in a system of the ECU that controls to drive corresponding components. Alternatively, whether the camshaft position sensors fail may be determined by analyzing a type of signal received from the camshaft position sensor.

When the camshaft position sensor of the intake cam or the exhaust cam is determined not to fail, an accurate crank angle may be determined using a measured value of the crankshaft position sensor and a measured value of the camshaft position sensor. Therefore, the fuel injection and the ignition are performed at an optimal fuel injection timing and an optimal ignition timing corresponding to the crank angle (S170). Consequently, the crank angle determination and the start completion determination are completed (S90 and S100).

However, when both the camshaft position sensors of the intake cam and the exhaust cam are determined to fail, as described above, sections (in a range of 0° to 360° and in a range of 360° to 720°), in which the crank angle detected from the crankshaft position sensors is located, may not be distinguished from each other.

In this case, normal driving of the vehicle is difficult. Therefore, the ECU executes a "limp-home" mode, which is a kind of safety mode, to allow the driver to quickly go to a maintenance shop and inspect a corresponding part (S50). In the limp-home mode, the RPM of the engine is limited or a speed change stage of a transmission is fixed. Meanwhile, the ECU performs control, which will be described below, to allow the engine to be started in the limp-home mode.

When the limp-home mode is executed, even though engine synchronization is impossible due to failures of the camshaft position sensors, the ECU forcibly switches to a full synchronization state to activate the injector (S60). As will described below, this is because of enabling the test injection for determining the crank angle (S70).

To this end, the ECU detects cylinders, each in which a piston comes close to a top dead-point, using the measured result of the crankshaft position sensor, and performs fuel injection and ignition on any one of the cylinders (S70). The cylinder coming close to the top dead-point is in a compression stroke or an exhaust stroke according to the crank angle section. When the cylinder to which the test injection is performed is a cylinder in the compression stroke, normal starting is achieved due to the test injection, and the driving of the starter motor is stopped. However, when the cylinder in which the test injection is performed is a cylinder in the exhaust stroke, normal fuel combustion may not be performed, so that the RPM of the engine may not rise above an RPM of the starter motor and the starter motor is still in operation.

Using the above described, the ECU monitors a state of the battery voltage after the test injection and the ignition using the battery voltage sensor, and compares the state of the battery voltage with the battery voltage value A which is detected and stored in the operation S20 (S80). When the fuel injection and the ignition are performed at the normal position and the normal timing, the RPM of the engine is normally driven over the RPM of the starter motor such that the battery voltage, which is reduced due to the driving of the starter motor drive, rises again. Consequently, when the current battery voltage exceeds the battery voltage value A detected and stored in the operation S20 on the basis of the monitoring result, as described with reference to FIG. 3, the fuel injection and the ignition may be determined to be performed at the normal position and the normal timing. Therefore, in this case, the crank angle and the starting may be determined to be completed (S90 and S100).

However, when the fuel injection and the ignition are not performed at the normal position and the normal timing, the RPM of the engine may not rise over the RPM of the starter motor such that the starter motor is still in operation. Consequently, as shown in FIG. 3, the current battery voltage is maintained as being reduced by the battery voltage decrease from the battery voltage value A detected and stored in the operation S20 due to the driving of the starter motor. Therefore, when the current battery voltage is less than or equal to the battery voltage value A detected and stored in the operation S20 on the basis of the monitoring result, the ECU may determine that the fuel injection and the ignition are not performed at the normal position and the normal timing.

In this case, since the ECU erroneously determines the sections (in the range of 0° to 360° and in the range of 360° to 720°), in which the crank angle detected from the crankshaft position sensors is positioned, the test injection is determined to be performed so that the ECU offsets the crank angle by 360° to correct the erroneous determination, thereby performing the engine synchronization (S110). Then, the fuel injection timing and the ignition timing are calculated on the basis of the offset crank angle, and the fuel injection and the ignition are performed at the calculated injection timing and the calculated ignition timing to restart the engine.

Thereafter, the state of the battery voltage is monitored again after the engine is restarted, and is compared with the battery voltage value A detected and stored in the operation S20 (S120). As described above, when the restarting of the engine restart is performed at the normal position and the normal timing, the current battery voltage exceeds the battery voltage value A detected and stored in the operation S20. In this case, the crank angle and the starting may be determined to be completed (S90 and S100).

When the current battery voltage is below the battery voltage value A detected and stored at the operation S20 even after the engine is restarted, the ECU offsets the crank angle by 360° and restarts the engine, and then determines whether the starting is completed again using the current battery voltage value (S110).

However, when the number of times the test injection is performed with respect to the crank angle exceeds a predetermined value at a current timing (S140), the ECU does not attempt an additional offset or restarting with respect to the crank angle so as to prevent damage to the engine due to excessive fuel injection during an attempt of the restarting in a condition in which the starting is impossible, and thus the ECU determines that the starting is impossible to stop the driving of the starter motor (S150). Meanwhile, a maximum number of times the test injection is attempted is initialized when the control method of the present disclosure begins, and is counted whenever the test injection is attempted.

Thereafter, the ECU informs the driver of abnormality of the camshaft position sensor 100 (S160). To this end, the ECU may turn on an engine warning light or display a failure on a cluster for the driver.

Alternatively, the ECU may inform the driver of the failure and also may store a diagnostic trouble code (DTC) related to a type of electrical fault occurring at the camshaft position sensor 100 in a storage device inside the vehicle (S160). Through such a process, the cause of problem can be easily determined in a subsequent maintenance process such that maintenance costs of the vehicle can be reduced.

Meanwhile, even though the fuel injection and the ignition are performed at the normal position and the normal timing, there may be a case in which the fuel combustion is not performed normally. In this case, even though the engine synchronization is accurately performed, the battery voltage value may not be recovered not to rise over the battery voltage value A stored in the operation S20. This is the case in which a failure occurs in combustion-related parts or an air-fuel ratio.

In consideration of the above, when the current battery voltage is determined to be below the battery voltage value A detected and stored in the operation S20, in order to determine whether a cause in which the starting is impossible is resulting from failure of parts related to the combustion, the ECU may determine whether failure occurs at the parts related to the combustion (S130). Preferably, in order to determine whether the failure occurs at the parts related to the combustion, the ECU diagnoses the injector 500, the spark plug 600, and the fuel pump 400 (S30), and determines whether at least one of the injector 500, the spark plug 600, and the fuel pump 400 fails (S40).

Whether at least one of the injector 500, the spark plug 600, and the fuel pump 400 fails may be determined through diagnostic information using an ASIC provided in a system of the ECU that controls to drive the injector 500, the spark plug 600, and the fuel pump 400.

When the failure occurs at the injector 500, the spark plug 600, or the fuel pump 400, the fuel supply, the fuel injection, and the ignition for each cylinder may not be performed normally. Consequently, the ECU determines that the starting is impossible and informs the driver of the failure (S160).

Meanwhile, when the current battery voltage is below the battery voltage value A detected and stored in the operation S20, in order to whether the cause in which the starting is impossible is resulting from abnormality of the air-fuel ratio, the ECU may determine whether abnormality occurs in the air-fuel ratio on the basis of a measured result from a lambda sensor (S130). When the abnormality is determined to occur in the air-fuel ratio, since normal starting of the engine is impossible and determination and solution for the abnormality cause are also impossible, as described above, the ECU determines that the starting is impossible and informs the driver of the failure (S160).

As described above, according to embodiments of the present disclosure, the battery voltage value is used as the reference of the determination for the crank angle and the starting completion. Thus, even when the failure occurs at the camshaft position sensor, the accurate crank angle can be determined such that the engine can be stably restarted.

Further, according to embodiments of the present disclosure, the battery voltage value is updated immediately before and whenever the engine is started, and the updated battery voltage value is used as a reference for determining whether the starting is completed. Consequently, according to embodiments of the present disclosure, the starting completion may be determined independent from influence of the state of the battery state of the vehicle and the external environments such as the temperature or the atmospheric pressure of the outside air.

Meanwhile, according to embodiments of the present disclosure, when a failure does not occur at the camshaft position sensor, the engine is synchronized and the starting completion is determined using the measured information from the corresponding camshaft position sensor.

However, even when a cam signal is normally received and no abnormality is determined to occur at the camshaft position sensor, there occurs a case in which actual sensor signal information from the actual crankshaft position sensor and the camshaft position sensor does not coincide with an actual physical engagement state of a crank. For example, when the exhaust cam and the intake cam are crossed installed when the engine is assembled, information on the crank angle received from the cam signal and a crank signal does not coincide with an actual crank angle. In this case, normal engine synchronization may be impossible with measured values using the camshaft position sensor and the crankshaft position sensor.

Consequently, even when no failure is determined to occur at the camshaft position sensor, a variation of the battery voltage after the test injection is performed may be utilized to assist determination whether the starting is completed. Accordingly, even when the actual sensor signal information from the crankshaft position sensor and the camshaft position sensor does not coincide with the physical engagement state of the actual crank, the crank angle and whether the starting is completed can be determined.

In accordance with embodiments of the present disclosure, the battery voltage value is used as a reference for determining the crank angle and starting completion, so that, even when a failure occurs at the camshaft position sensor, the crank angle can be accurately determined such that the engine can be stably restarted.

Further, in accordance with embodiments of the present disclosure, a battery value is updated immediately before and whenever the engine is started, and is used such that the starting completion may be determined independent from influence of the battery state of the vehicle and the external environments such as the temperature or the atmospheric pressure of the outside air.

While the present disclosure has been described with respect to certain embodiments, it will be apparent to those skilled in the art that various changes and modifications may be made without departing from the spirit and scope of the disclosure as defined in the following claims.

What is claimed is:

1. A method for controlling starting of a vehicle comprising an internal combustion engine upon failure of a camshaft position sensor, the method comprising:

driving a starter motor of the internal combustion engine in response to an ignition key being turned on;

performing, by an injector and an ignitor, test fuel injection and ignition based on a predetermined crank angle;

monitoring, by an electronic control unit (ECU), the battery voltage detected by a battery voltage sensor after the performing of the test injection and ignition; and when the battery voltage rises over the predetermined value after the performing of the test injection and ignition, determining, by the ECU, that the test injection and ignition are performed at the normal timing to complete determination of the crank angle.

2. The method of claim 1, further comprising:

when the battery voltage of the vehicle does not rise over the predetermined value after the performing of fuel injection and ignition for starting the internal combustion engine, determining that the fuel injection and the ignition are not performed at the normal timing; and when the fuel injection and the ignition are not performed at the normal timing, offsetting a crank angle, which is recognized through measurement, by 360° to restart the internal combustion engine.

3. The method of claim 1, further comprising:

when the battery voltage does not rise over the predetermined value after the performing of the test injection and ignition, performing the fuel injection and ignition based on the crank angle offset by 360° to restart the internal combustion engine.

4. The method of claim 3, further comprising:

when the battery voltage does not rise over the predetermined value after the restarting of the internal combustion engine, re-offsetting the offset crank angle by 360° to restart the internal combustion engine based on the re-offset crank angle.

5. The method of claim 4, further comprising:

counting a number of times the offsetting of the crank angle and the re-offsetting of the crank angle are performed; and when the number of times is greater than or equal to a predetermined value, determining that the starting of the internal combustion engine is disabled.

6. The method of claim 1, further comprising:

after a starter motor is driven, determining whether the camshaft position sensor fails.

7. The method of claim 6, further comprising:

when a failure is determined to occur at the camshaft position sensor, executing a limp-home mode.

8. The refrigerator of claim 1, further comprising:

measuring the battery voltage before a starter motor is driven; and setting the measured battery voltage as the predetermined value.

9. The method of claim 1, further comprising:

when the battery voltage does not rise over the predetermined value after the performing of the fuel injection and ignition for starting the internal combustion engine, determining whether an abnormality occurs at a part of the vehicle related to combustion; and when the abnormality is determined to occur at the part of the vehicle related to combustion, determining that the starting of the internal combustion engine is disabled.

10. The method of claim 9, wherein the part of the vehicle related to combustion is an injector, a spark plug, or a fuel pump.

11. The method of claim 9, further comprising:

when the battery voltage does not rise over the predetermined value after the restarting of the internal combustion engine, determining whether an air-fuel ratio is within a normal range; and when the air-fuel ratio is outside of the normal range, determining that the starting of the internal combustion engine is disabled.

12. The method of claim 9, further comprising:

when it is determined that the starting of the internal combustion engine is disabled, stopping the driving of the starter motor of the internal combustion engine; and notifying a driver of the vehicle of a failure.

13. The method of claim 12, further comprising:

when it is determined that the starting of the internal combustion engine is disabled, storing a diagnostic trouble code (DTC) related to failure information of the camshaft position sensor in a storage device of the vehicle.

14. The method of claim 1, wherein the test injection and the ignition are performed for an arbitrary cylinder proximate to a top dead-point using the crankshaft position sensor.

* * * * *